US012601261B2

(12) United States Patent
Hockley et al.

(10) Patent No.: US 12,601,261 B2
(45) Date of Patent: Apr. 14, 2026

(54) SHELL STATOR FOR A VACUUM PUMP

(71) Applicant: Edwards Limited, Burgess Hill (GB)

(72) Inventors: Robin Hockley, Burgess Hill (GB); Alan Ernest Kinnaird Holbrook, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 0 days.

(21) Appl. No.: 18/873,984

(22) PCT Filed: Aug. 30, 2023

(86) PCT No.: PCT/GB2023/052235
§ 371 (c)(1),
(2) Date: Dec. 11, 2024

(87) PCT Pub. No.: WO2024/062215
PCT Pub. Date: Mar. 28, 2024

(65) Prior Publication Data

US 2025/0369356 A1 Dec. 4, 2025

(30) Foreign Application Priority Data

Sep. 22, 2022 (GB) ..... 2213812
Jun. 8, 2023 (GB) ..... 2308577

(51) Int. Cl.
*F01C 21/10* (2006.01)
*F04C 25/02* (2006.01)
*F04C 27/00* (2006.01)

(52) U.S. Cl.
CPC ..... *F01C 21/104* (2013.01); *F04C 25/02* (2013.01); *F04C 27/001* (2013.01); *F04C 27/005* (2013.01)

(58) Field of Classification Search
CPC ..... F01C 21/104; F04C 25/02; F04C 27/001; F04C 27/005
See application file for complete search history.

(56) References Cited

U.S. PATENT DOCUMENTS 6,572,351 B2 * 6/2003 Durand ..... F04C 18/086 418/9
9,739,278 B2 * 8/2017 Holbrook ..... F04C 27/006
(Continued)

FOREIGN PATENT DOCUMENTS

CN 112815092 A 5/2021
CN 113123958 A 7/2021
(Continued)

OTHER PUBLICATIONS

Combined Search and Examination Report from counterpart GB Application No. 2308570.7, dated Dec. 5, 2023, 7 Pages.
(Continued)

*Primary Examiner* — Jesse S Bogue
(74) *Attorney, Agent, or Firm* — Shumaker & Sieffert, P.A.

(57) ABSTRACT

A shell stator (12, 14) for a vacuum pump, the shell stator (12, 14) comprising: a seal groove (50, 52) formed in a surface of the shell stator (12, 14), the seal groove (50, 52) being defined by a first side wall (60), a second side wall (62) opposite to the first side wall (60), and a bottom surface (64) disposed between the first side wall (60) and the second side wall (62), the bottom surface (64) being opposite to an opening of the seal groove (50, 52); wherein the seal groove (50, 52) comprises: a protrusion (68) formed in the first side wall (60) and extending towards the second side wall (62); and an indentation (69) formed in the second side wall (62) opposite to the protrusion (68).

11 Claims, 4 Drawing Sheets

(56) References Cited

U.S. PATENT DOCUMENTS

| | | | | |
|---|---|---|---|---|
| 9,879,677 | B2 | 1/2018 | Kailasam et al. | |
| 11,421,689 | B2 * | 8/2022 | Schofield | F04C 27/009 |
| 2004/0017049 | A1 | 1/2004 | Fink | |
| 2009/0243229 | A1 | 10/2009 | Yoshida | |
| 2013/0249173 | A1 | 9/2013 | Yamamoto | |
| 2016/0201671 | A1 | 7/2016 | Moeser et al. | |
| 2017/0204858 | A1 * | 7/2017 | Holbrook | F04C 25/02 |
| 2017/0204859 | A1 * | 7/2017 | Holbrook | F04C 23/001 |
| 2020/0284252 | A1 | 9/2020 | Stark et al. | |
| 2021/0340979 | A1 | 11/2021 | Shinoda et al. | |
| 2022/0155014 | A1 | 5/2022 | Toro | |
| 2022/0269257 | A1 | 8/2022 | Gordon et al. | |
| 2023/0033204 | A1 * | 2/2023 | Olivier | F04C 25/02 |
| 2023/0323888 | A1 * | 10/2023 | Holbrook | F04C 25/02 415/214.1 |

FOREIGN PATENT DOCUMENTS

| | | | |
|---|---|---|---|
| CN | 218094518 | U | 12/2022 |
| EP | 2650572 | A1 | 10/2013 |
| EP | 4027276 | A1 | 7/2022 |
| FR | 3112174 | A1 | 1/2022 |
| GB | 1206524 | A | 9/1970 |
| GB | 2559136 | A | 8/2018 |
| GB | 2575987 | A | 2/2020 |
| GB | 2591500 | A | 8/2021 |
| JP | S6058960 | U | 4/1985 |
| JP | H029975 | A | 1/1990 |
| JP | H0211766 | A | 1/1990 |
| JP | 2008298246 | A | 12/2008 |
| JP | 2011185224 | A | 9/2011 |
| JP | 2020070727 | A | 5/2020 |
| WO | 2011018598 | A2 | 2/2011 |
| WO | 2015175814 | A1 | 11/2015 |
| WO | 2016012758 | A1 | 1/2016 |
| WO | 2020229163 | A1 | 11/2020 |
| WO | 2022117607 | A1 | 6/2022 |
| WO | 2022179819 | A1 | 9/2022 |

OTHER PUBLICATIONS

International Search Report and Written Opinion of International Application No. PCT/GB2023/052232, dated Nov. 8, 2023, 13 Pages.

International Search Report and Written Opinion of International Application No. PCT/GB2023/052234, dated Nov. 6, 2023, 11 Pages.

International Search Report and Written Opinion of International Application No. PCT/GB2023/052235, dated Nov. 28, 2023, 12 Pages.

Search Report from counterpart GB Application No. 2213812.7, dated Mar. 20, 2023, 2 Pages.

Search Report from counterpart GB Application No. 2308577.2, dated Nov. 30, 2023, 2 Pages.

Office Action from U.S. Appl. No. 18/873,978 dated Oct. 27, 2025, p. 26.

Notice of Allowance from U.S. Appl. No. 18/873,978 dated Mar. 6, 2026, 9 pp.

Office Action from U.S. Appl. No. 18/873,937 dated Jan. 15, 2026, 10 pp.

Response to Office Action dated Oct. 27, 2025 from U.S. Appl. No. 18/873,978, filed Jan. 27, 2026, 14 pp.

* cited by examiner

SHELL STATOR FOR A VACUUM PUMP

This application is a national stage entry under 35 U.S.C. § 371 of International Application No. PCT/GB2023/052235, filed Aug. 30, 2023, which claims the benefit of GB Application No. 2213812.7, filed Sep. 22, 2022, and GB Application No. 2308577.2, filed Jun. 8, 2023, the entire contents of each of which are incorporated herein by reference.

TECHNICAL FIELD

The field of the disclosure relates to a shell stator for vacuum pump, and a vacuum pump.

SUMMARY

Rotating machines, such as compressors or vacuum pumps, need to be carefully designed and manufactured in order for the moving parts to cooperate with each other accurately. Providing effective seals to seal the machine tends to be problematic, particularly when fluid flow is encouraged by a pressure difference between the machine and ambient environment. It is desired to provide improved sealing.

In an aspect, there is provided a shell stator for a vacuum pump. The shell stator comprises: a seal groove formed in a surface of the shell stator, the seal groove being defined by a first side wall, a second side wall opposite to the first side wall, and a bottom surface disposed between the first side wall and the second side wall, the bottom surface being opposite to an opening of the seal groove; wherein the seal groove comprises a biasing means for biasing a sealing gasket within the seal groove (e.g. to a particular position within the seal groove). The biasing means comprises a protrusion formed in the first side wall and extending towards the second side wall, and an indentation formed in the second side wall opposite to the protrusion.

The protrusion may be a continuous curved hump.

The indentation may be a continuous curved indentation.

The seal groove may comprise a plurality of protrusions formed in the first side wall and extending towards the second side wall, and a plurality of indentations formed in the second side wall, each indentation of the plurality of indentations being opposite to a respective protrusion of the plurality of protrusions.

The seal groove may be formed in a joining surface of the shell stator, the joining surface being for receiving a further shell stator thereby to define at least one pumping chamber.

The seal groove may be formed in an end surface of the shell stator, the end surface being for receiving an end piece.

The shell stator may further comprise: a further seal groove formed in the surface of the shell stator, the further seal groove being defined by a third side wall, a fourth side wall opposite to the third side wall, and a further bottom surface disposed between the third side wall and the fourth side wall, the further bottom surface being opposite to an opening of the further seal groove. The further seal groove may comprise: a further protrusion formed in the third side wall and extending towards the fourth side wall; and a further indentation formed in the fourth side wall opposite to the further protrusion. The first side wall and the third side wall may be the outermost walls. The second side wall and the fourth side wall may be the innermost walls. The shell stator may further comprise a curved seal groove formed in an end surface of the shell stator, the curved seal groove being formed between the seal groove and the further seal groove.

In a further aspect, there is provided a system comprising: the shell stator of any preceding aspect; and a sealing gasket disposed in the seal groove; wherein the protrusion biases at least part of the sealing gasket towards or into a particular position within the seal groove, such as against the second side wall.

A thickness of the sealing gasket in a direction from the first side wall to the second side wall may be less than the size of the seal groove in said direction.

The sealing gasket may have substantially uniform thickness.

In a further aspect, there is provided a vacuum pump, comprising: shell stators defining at least one pumping chamber, at least one of the shell stators being a shell stator according to any preceding aspect; end pieces mounted at either end of the shell stators; and a sealing gasket disposed between the shell stators and the end pieces, the sealing gasket being disposed in the seal groove; wherein the protrusion biases at least part of the sealing gasket against the second side wall.

The at least one of the shell stators may further comprise a further seal groove formed in the surface of that shell stator, the further seal groove being defined by a third side wall, a fourth side wall opposite to the third side wall, and a further bottom surface disposed between the third side wall and the fourth side wall, the further bottom surface being opposite to an opening of the further seal groove. The further seal groove may comprise: a further protrusion formed in the third side wall and extending towards the fourth side wall; and a further indentation formed in the fourth side wall opposite to the further protrusion. The first side wall and the third side wall may be the outermost walls relative to the at least one pumping chamber. The second side wall and the fourth side wall may be the innermost walls relative to the at least one pumping chamber. The sealing gasket may be also disposed in the further seal groove. The protrusion and the further protrusion may bias at least part of the sealing gasket against the innermost side walls.

The vacuum pump may further comprising two closed-shape sealing grooves, each closed-shape sealing groove being formed in a respective end of the shell stators. The sealing gasket may comprise two sealing members each defining a closed shape, each of the sealing members being disposed in a respective one of the closed-shape sealing grooves. Each closed-shape sealing groove may be defined by an outer wall, an inner wall opposite to the outer wall, and a bottom surface disposed between the outer wall and the inner wall, the bottom surface being opposite to an opening of the closed-shape sealing groove. Each closed-shape sealing groove may comprise: a protrusion formed in the outer wall and extending towards the inner wall; and an indentation formed in the inner wall opposite to the protrusion; and the protrusion of a closed-shape sealing groove biases at least part of the sealing members disposed in that closed-shape sealing groove against the inner wall of that closed-shape sealing groove.

BRIEF DESCRIPTION OF DRAWINGS

The present disclosure will now be described, by way of example only, with reference to the accompanying drawings.

DETAILED DESCRIPTION

Figure 1:
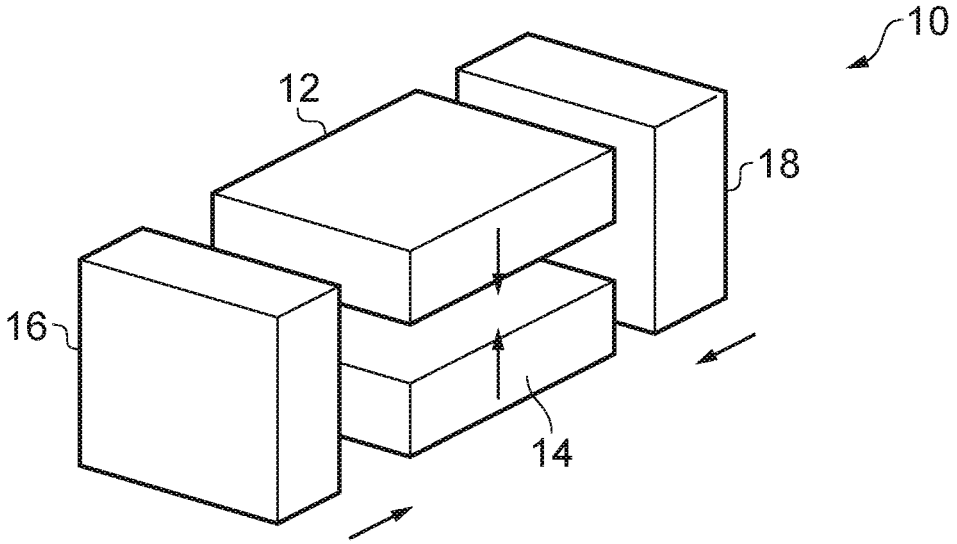
FIG. 1 is a schematic illustration (not to scale) showing a housing of a vacuum pump.

FIG. 1 is a schematic illustration (not to scale) showing a housing 10 of a vacuum pump, according to one example. The housing 10 comprises a pair of shell stators 12, 14 and a pair of end plates 16, 18. The shell stators 12, 14 define recesses which receive components of the vacuum pump. The shell stators 12, 14 are brought together to retain the components in those recesses. The end plates 16, 18 are then brought to retain the shell stators 12, 14. This provides for particularly convenient assembly of the vacuum pump.

In other words, the housing 10 of the vacuum pump may be formed from multiple component parts, including shells 12, 14 and end plates 16, 18 which need to be sealed upon assembly. In the arrangement shown in FIG. 1, the stator is formed by bringing together the two housing parts or shells 12, 14 which are then retained between the pair of end plates 16, 18.

As will be explained in more detail below, in this example, to adequately seal the shell stators 12, 14 together, one or more (e.g. two) longitudinal seals are located along the joining faces of the shell stators 12, 14. Also, to ensure adequate sealing between the shell stators 12, 14 and the respective end plates 16, 18, a pair of seals that define closed shapes (e.g. annular seals in some examples) is located between the end plates 16,18 and the shell stators 12, 14.

Figure 2:
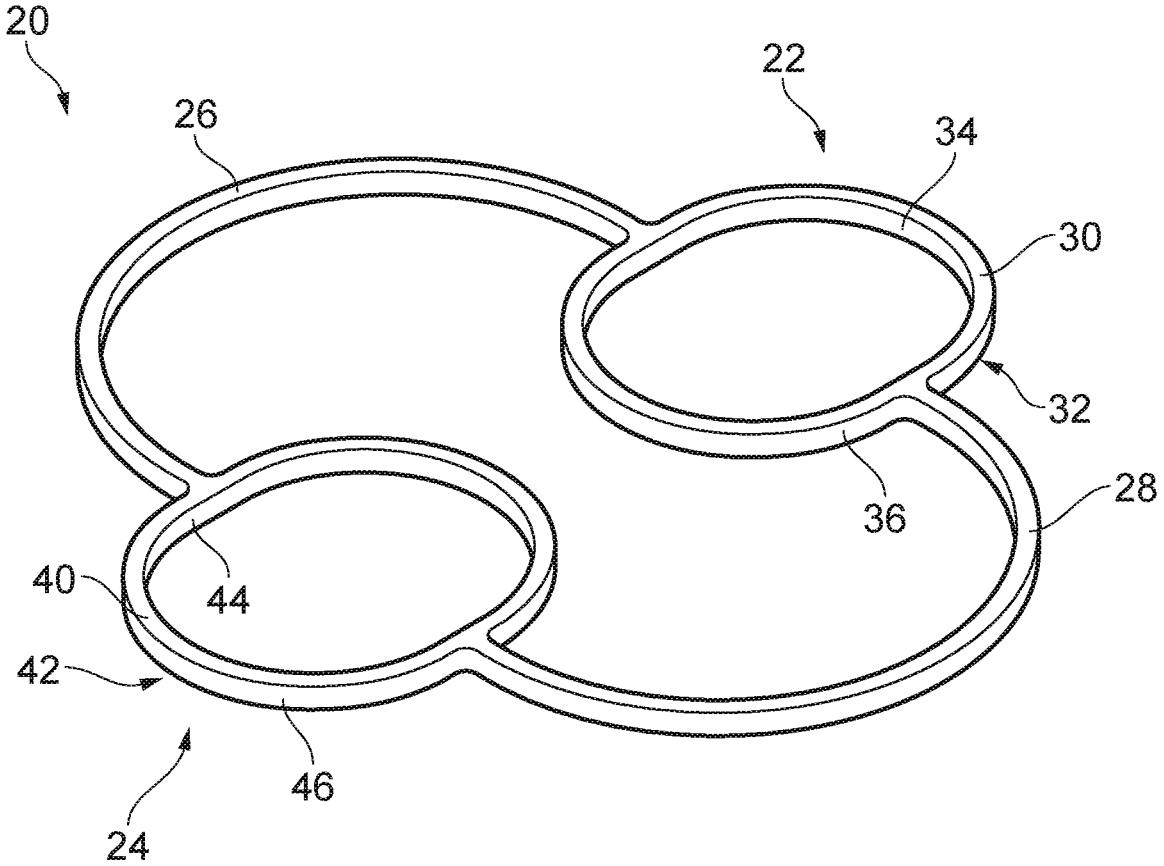
FIG. 2 is a schematic illustration (not to scale) of a sealing gasket.

FIG. 2 is a schematic illustration (not to scale) of a sealing gasket 20 for sealing the housing 10, according to one example.

The sealing gasket 20 comprises a first closed-shape sealing member 22 (which may be approximately annular), a second closed-shape sealing member 24 (which may be approximately annular), a first longitudinal sealing member 26, and a second longitudinal sealing member 28.

The first closed-shape sealing member 22 comprises a first surface 30, a second surface 32 opposite the first surface 30, a first radially inner surface 34, and a first radially outer surface 36 opposite to the first radially inner surface 34. The first radially inner surface 34 and the first radially outer surface 36 are disposed between the first surface 30 and the second surface 32.

The second closed-shape sealing member 24 comprises a third surface 40, a fourth surface 42 opposite the third surface 40, a second radially inner surface 44, a second radially outer surface 46 opposite to the second radially inner surface 44. The second radially inner surface 44 and the second radially outer surface 46 are disposed between the third surface 40 and the fourth surface 42.

The first longitudinal sealing member 26 is connected or attached between the first radially outer surface 36 (of the first closed-shape sealing member 22) and the second radially outer surface 46 (of the second closed-shape sealing member 24).

The second longitudinal sealing member 28 is connected or attached between the first radially outer surface 36 (of the first closed-shape sealing member 22) and the second radially outer surface 46 (of the second closed-shape sealing member 24).

The second longitudinal sealing member 28 is arranged opposite to the first longitudinal sealing member 26. That is to say, the second longitudinal sealing member 28 is connected to the first and second closed-shape sealing members 22, 24 and at an opposite side of the first and second closed-shape sealing members 22, 24 to the side at which the first longitudinal sealing member 26 is connected to the first and second closed-shape sealing members 22, 24.

The first closed-shape sealing member 22 defines a closed shape and may be a ring-shaped sealing member. The first closed-shape sealing member 22 has a square or rectangular cross-section.

The second closed-shape sealing member 24 defines a closed shape and may be a ring-shaped sealing member. The second closed-shape sealing member 24 has a square or rectangular cross-section.

The first longitudinal sealing member 26 may be an O-ring cord, which may have a circular cross-section. The first longitudinal sealing member 26 has a square or rectangular cross-section.

The second longitudinal sealing member 28 may be an O-ring cord, which may have a circular cross-section. The second longitudinal sealing member 28 has a square or rectangular cross-section.

In this example, the sealing gasket 20 is a continuous one-piece sealing gasket.

The sealing gasket 20 is made of a deformable or flexible material, such as an elastomer material (e.g. a fluoroelastomers (FKM/FPM) or a perfluoroelastomer (FFKM)) or silicon, such that the sealing gasket 20 is deformable or flexible. Thus, the sealing gasket 20 may be deformed into a desired shape or configuration suitable for use as a seal for the housing 10.

Figure 3:
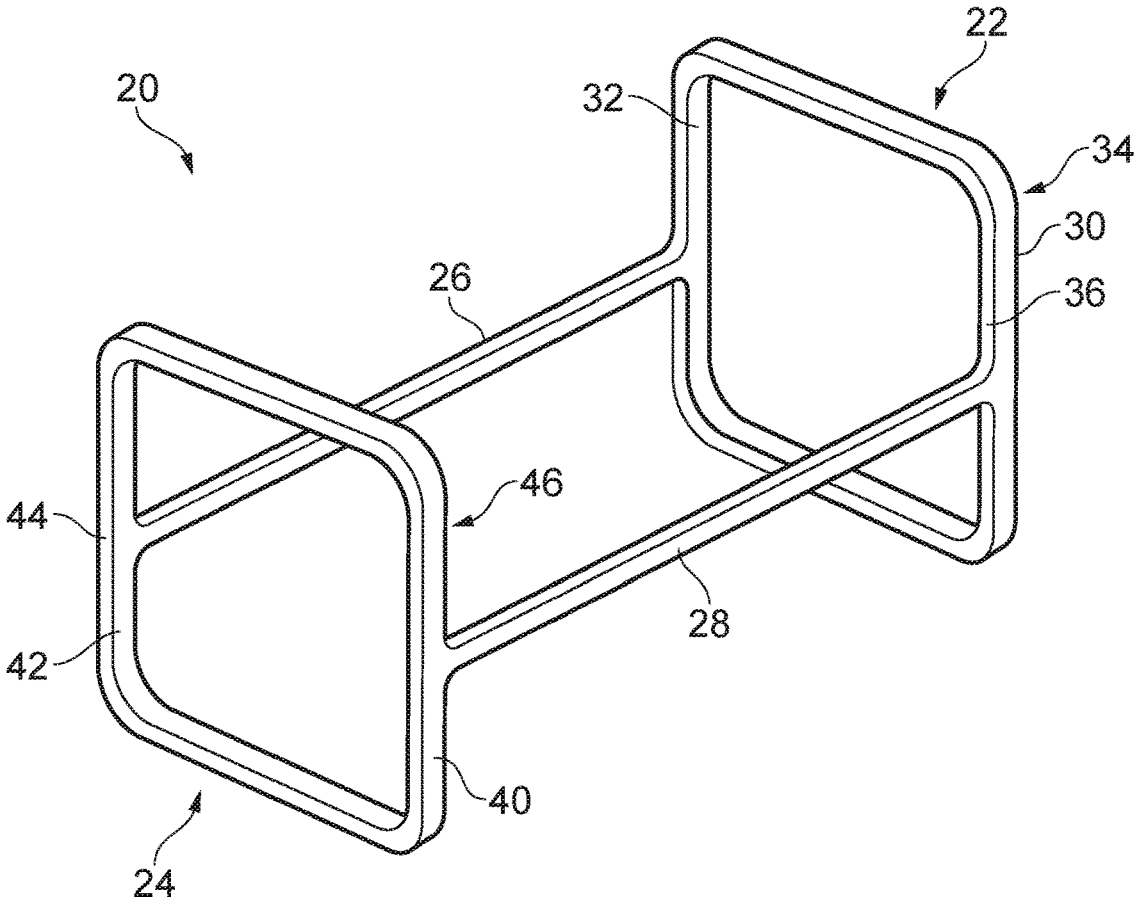
FIG. 3 is a further schematic illustration (not to scale) of the sealing gasket.

FIG. 3 is a schematic illustration (not to scale) showing the sealing gasket 20 that has been deformed into a configuration that may be suitable for sealing the housing 10.

In this configuration, the first and second closed-shape sealing members 22, 24 are square ring-shaped members with curved corners. The configuration has major faces (which are the first radially inner surface 34 and the first radially outer surface 36 of the first closed-shape sealing member 22, and the second radially inner surface 44 and the second radially outer surface 46 of the second closed-shape sealing member 24) which, in use, abut against major faces of the end plates 16, 18 and the adjacent faces of the shell stators 12, 14. In this example, the first and second closed-shape sealing members 22, 24 have substantially planar, axially outer faces, provided by the first radially inner surface 34 and the second radially inner surface 44 respectively. The first and second closed-shape sealing members 22, 24 have substantially planar, axially inner faces, provided by the first radially outer surface 36 and the second radially outer surface 46 respectively. The longitudinal sealing members 26 are connected between the facing axially inner faces of the first and second closed-shape sealing members 22, 24 (i.e., between the first radially outer surface 36 and the second radially outer surface 46). The first and second closed-shape sealing members 22, 24 have substantially constant thicknesses.

Figure 4:
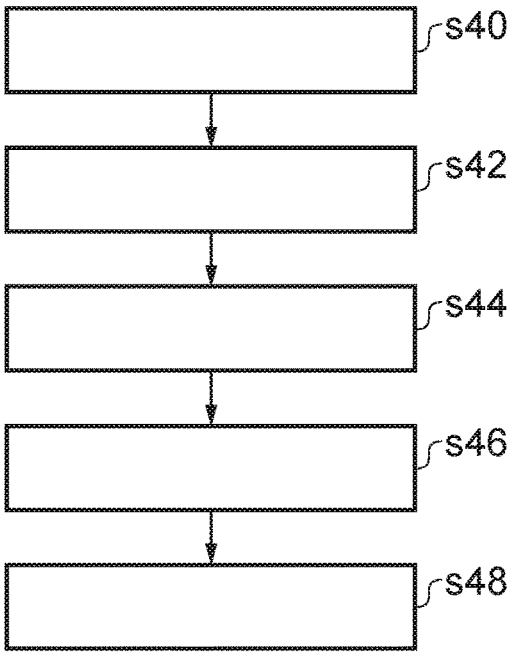
FIG. 4 is a process flow chart showing certain steps of a method of incorporating the sealing gasket into the housing.

FIG. 4 is a process flow chart showing certain steps (s40-*s*48) of a method of fitting, installing, or incorporating the sealing gasket 20 into the housing 10.

Figure 5:
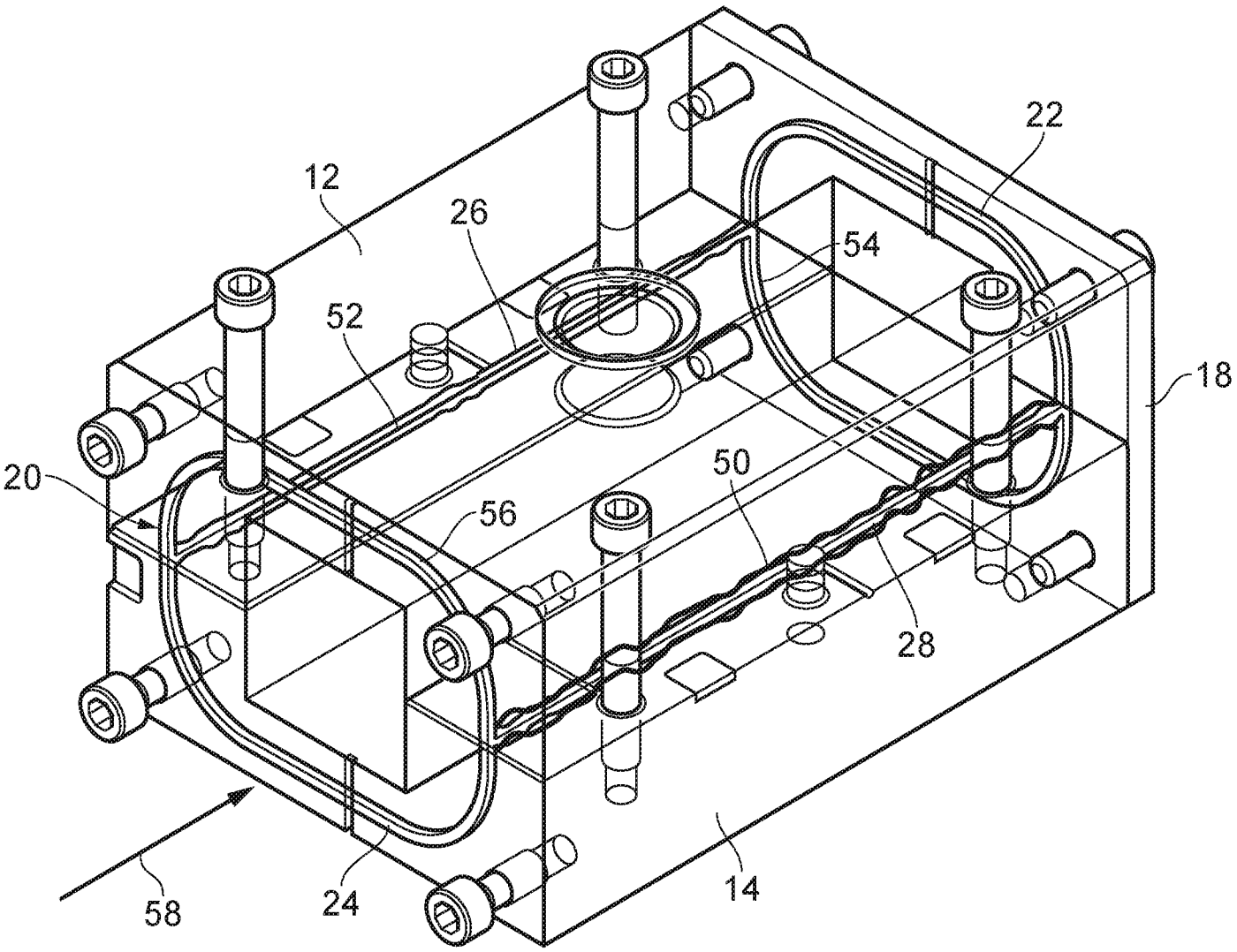
FIG. 5 is a schematic illustration (not to scale) showing the sealing gasket located in the housing.

FIG. 5 is a schematic illustration (not to scale) illustrating the sealing gasket 20 incorporated into the housing 10.

At step s40, the shell stator 14 is provided, into which components of the vacuum pump may be assembled.

At step s42, the sealing gasket 20 is positioned relative to the shell stator 14 such that the first and second longitudinal sealing members 26, 28 are located along the joining face of shell stator 14. The longitudinal sealing members 26, 28 are located in respective longitudinal seal grooves 50, 52 extending along the joining face of shell stator 14, as depicted in FIG. 5.

The longitudinal seal grooves 50, 52 and the locating therein of the longitudinal sealing members 26, 28 is described in more detail later below with reference to FIG. 6.

At step s44, the shell stator 12 is brought into close contact with the longitudinal sealing members 26, 28. In particular, the shell stator 12 is moved onto the longitudinal sealing members 26, 28 towards the joining face of shell stator 14. FIG. 5 shows the shell stators 12, 14 that have been arranged in this way.

At step s46, the shell stators 12, 14 are clamped together, which compresses the longitudinal sealing members 26, 28. The shell stators 12, 14 are fixed together to form pump chambers.

After step s46, the first and second closed-shape sealing members 22, 24 tend to extend or protrude axially from the axial ends of the assembled together shell stators 12, 14.

At step s48, the end plates 16, 18 are brought together to compress the first and second closed-shape sealing members 22, 24 in the axial (i.e. longitudinal) direction.

The first and second closed-shape sealing members 22, 24 are located in closed-shape (e.g. loop) seal grooves 54, 56 located in the shell stators 12, 14 and/or the end plates 16, 18.

The closed-shape seal grooves 54, 56 and the locating therein of the first and second closed-shape sealing members 22, 24 is described in more detail later below with reference to FIG. 7.

Referring to FIG. 5, the end plate 18 is shown having been moved onto the first annular sealing member 22 at a first end of the assembled together shell stators 12, 14. The end plate 16 may be moved onto the second annular sealing member 24 at a second end (opposite to the first end) of the assembled together shell stators 12, 14, as indicated in FIG. 5 by an arrow and the reference numeral 58.

Thus, a method of fitting, installing, or incorporating the sealing gasket 20 into the housing 10 is provided.

Figure 6:
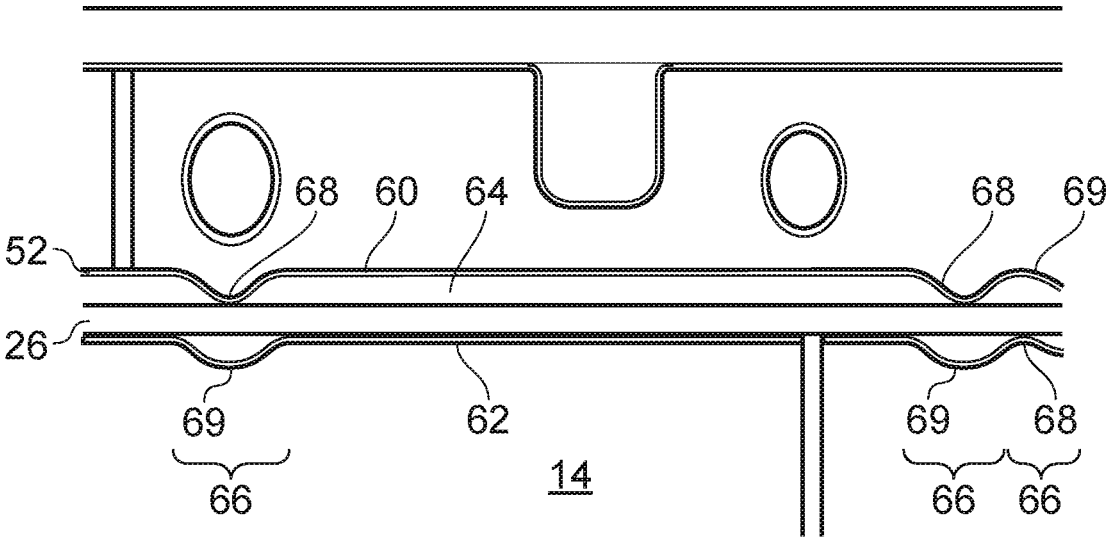
FIG. 6 is a schematic illustration (not to scale) showing a plan view of a first longitudinal sealing member located in a first longitudinal seal groove.

FIG. 6 is a schematic illustration (not to scale) showing a plan view of the first longitudinal sealing member 26 located in the first longitudinal seal groove 52. It will be appreciated by those skilled in the art that the second longitudinal sealing member 28 is located in the second longitudinal seal groove 50 in similar fashion.

The first longitudinal seal groove 52 extends along, and is formed in, the joining face of shell stator 14.

The first longitudinal seal groove 52 comprises a first side wall 60, a second side wall 62 opposite to the first side wall 60, and a bottom surface 64 disposed between the first side wall 60 and the second side wall 62. The first side wall 60 is the surface of the first longitudinal seal groove 52 furthest from the pumping chamber(s). The second side wall 62 is the surface of first longitudinal seal groove 52 closest to the pumping chamber(s). The bottom surface 64 is opposite to an opening of the first longitudinal seal groove 52.

The first longitudinal seal groove 52 comprises biasing means 66 for biasing the first longitudinal seal groove 52 against the second side wall 62. In this example, there is a plurality of biasing means 66 arranged in a spaced apart arrangement along the length of the first longitudinal seal groove 52.

Each biasing means 66 comprises a respective protrusion 68 and a respective indentation 69. The protrusion 68 is formed in the first side wall 60. The protrusion 68 extends from the first side wall 60 towards the second side wall 62. The indentation 69 is formed in the second side wall 62 opposite to the protrusion 68.

Sealing grooves, such as the first and second longitudinal seal grooves 50, 52, may provide a leakage passage for gases between the low vacuum and high vacuum ends of the pump. In this example, the longitudinal sealing members 26, 28 are biased against the pumping chamber sides (i.e. the innermost sides, with respect to the pumping chambers(s)) of the longitudinal seal grooves 50, 52. This advantageously tends to block this leak passage.

In this example, first and second longitudinal seal grooves 50, 52 are wider than the longitudinal sealing members 26, 28 located therein. This tends to provide freedom for some lateral movement and the ability for the sealing gasket 20 to expand, for example due to the heating and/or compression of the sealing gasket 20.

In some examples, one or more protrusions are formed in the second side wall and extend towards the first side wall, and one or more indentations are formed in the first side wall opposite to respective protrusions.

Preferably, the longitudinal seal grooves 50, 52 each have a constant width and thus tend to be machinable in one pass with one tool. This tends to provide an advantage over grooves which, for example, comprises one or more sections of reduced width for gripping the sealing gasket. Furthermore, the absence of such narrowed sections tends to reduce the chances of there being pinch points for the gasket as it expands under compression and temperature changes.

Figure 7:
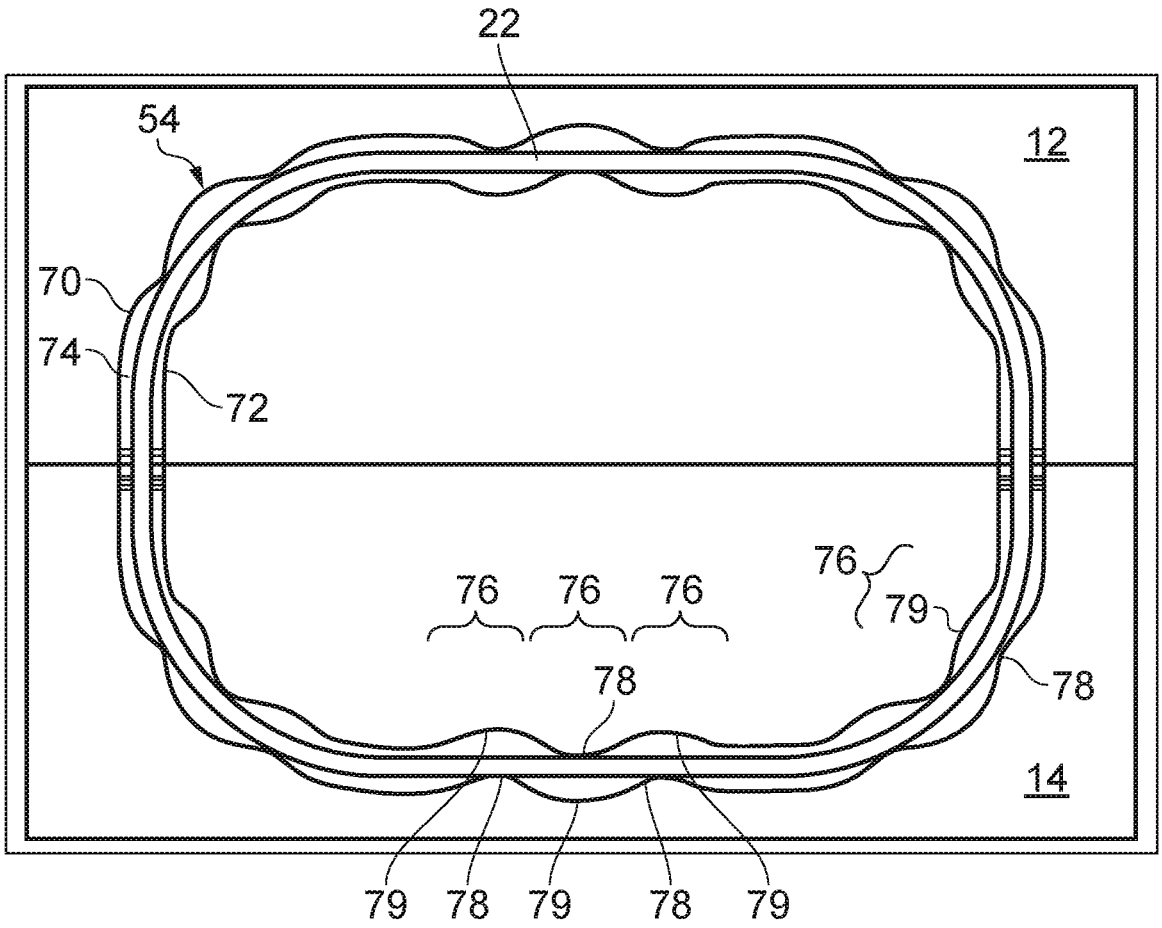
FIG. 7 is a schematic illustration (not to scale) showing a first closed-shape sealing member located in a first closed-shape seal groove.

FIG. 7 is a schematic illustration (not to scale) showing the first closed-shape sealing member 22 located in a first closed-shape seal groove 54. It will be appreciated by those skilled in the art that the second closed-shape sealing member 24 is located in the second closed-shape seal groove 56 in similar fashion.

The first closed-shape seal groove 54 may be formed in end surfaces of the shell stators 12, 14 and/or a joining surface of the end plate 18.

The closed-shape seal groove 54 comprises a first side wall 70, a second side wall 72 opposite to the first side wall 70, and a bottom surface 74 disposed between the first side wall 70 and the second side wall 72. The first side wall 70 is the surface of the first closed-shape seal groove 54 furthest from the centre of the closed shape defined by the first closed-shape seal groove 54. The second side wall 72 is the surface of first closed-shape seal groove 54 closest to the centre of the closed shape defined by the first closed-shape seal groove 54. The bottom surface 74 is opposite to an opening of the first closed-shape seal groove 54.

The first closed-shape seal groove 54 comprises biasing means 76 for biasing the first closed-shape seal groove 54 towards a central portion of the first closed-shape seal groove 54. In this example, there is a plurality of biasing means 76 arranged in a spaced apart arrangement about the first closed-shape seal groove 54. For reasons of clarity, only some of the biasing means 76 are indicated by reference symbols in FIG. 7.

Each biasing means 76 comprises a respective protrusion 78 and a respective indentation 79. The protrusion 78 is formed in either the first side wall 70 or the second side wall 72, and extends towards the opposite side wall 70, 72. The indentation 79 is formed in the other of the second side wall 72 or the first side wall 70, and is opposite to the protrusion 78.

In this example, first and second closed-shape seal grooves 54, 56 are wider than the first and second closed-shape sealing members 22, 24 located therein. This tends to provide freedom for some lateral/radial movement and the ability for the sealing gasket 20 to expand, for example due to the heating and/or compression of the sealing gasket 20. Further, by biasing the first and second closed-shape sealing members 22, 24 towards the central portions of the closed-shape seal grooves 54, 56, expansion of the sealing members 22, 24 in both inward and outward radial directions tends to be permitted.

Preferably, the closed-shape seal grooves 54, 56 each have a constant width and thus tend to be machinable in one pass with one tool. This tends to provide an advantage over grooves which, for example, comprise one or more sections of reduced width for gripping the sealing gasket. Furthermore, the absence of such narrowed sections tends to reduce the chances of there being pinch points for the gasket as it expands under compression and temperature changes.

In the above examples, each protrusion may be a continuous curved hump or bump. Preferably, protrusions omit discontinuities or sharp corners, i.e. they are smooth. This advantageously tends to reduce the likelihood of damage to the sealing gasket.

In the above examples, each indentation may be a continuous curved indentation, cavity, or void. Preferably, indentations omit discontinuities or sharp corners, i.e. they are smooth. This advantageously tends to reduce the likelihood of damage to the sealing gasket.

Use of biasing or positioning means that use only structural features of the sealing grooves for positions the sealing gasket within the sealing groove advantageously tends to allow for the use of sealing gaskets having simpler geometries. This tends to facilitate design, manufacture, and cost of the sealing gaskets. Sealing gaskets may frequently be repaired or replaced compared to, for example, the shell stators or end plates.

The sealing gasket tends to be easy to install into a housing or a vacuum pump.

It will be appreciated that the cord and the gasket can have different shapes or thicknesses to suit the arrangement of the housing.

In the above examples, the sealing gasket is a continuous one-piece sealing gasket. However, in other examples, the sealing gasket comprises multiple separate parts that are joined together. The multiple parts may be joined together by any joining means or methods, such as using an adhesive, fusion, or via an interference fit.

In the above examples, the sealing gasket has substantially constant cross-section over its parts. However, in other examples, the sealing gasket has non-constant cross-section.

In the above examples, the sealing gasket has square or rectangular cross-section. However, in other examples, some or all of the sealing gasket has an alternative cross-section other than square or rectangular, such as circular, triangular, oval, etc.

In the above examples, the sealing gasket may be made of an elastomer. In some examples, the sealing gasket may be made of a different, deformable material, for example, a metal.

Although the major faces of the sealing gasket in the above examples are substantially planar, it will be appreciated that they may be any shape which is suitable for engaging with the major faces of the end plates and the adjacent faces of the shell stators.

Although illustrative examples of the disclosure have been disclosed in detail herein, with reference to the accompanying drawings, it is understood that the disclosure is not limited to the precise example and that various changes and modifications can be effected therein by one skilled in the art without departing from the scope of the disclosure as defined by the appended claims and their equivalents.

The invention claimed is:

1. A system comprising:

a shell stator for a vacuum pump, the shell stator comprising:

a seal groove formed in a surface of the shell stator, the seal groove being defined by a first side wall, a second side wall opposite to the first side wall, and a bottom surface disposed between the first side wall and the second side wall, the bottom surface being opposite to an opening of the seal groove; wherein:

the seal groove comprises:

a protrusion formed in the first side wall and extending towards the second side wall;

an indentation formed in the second side wall opposite to the protrusion; wherein a sealing gasket disposed in the seal groove; and wherein the protrusion biases at least part of the sealing gasket against the second side wall.

2. The system of claim 1, wherein the protrusion is a continuous curved hump.

3. The system of claim 1, wherein the indentation is a continuous curved indentation.

4. The system of claim 1, wherein the seal groove comprises:

a plurality of protrusions formed in the first side wall and extending towards the second side wall; and a plurality of indentations formed in the second side wall, each indentation of the plurality of indentations being opposite to a respective protrusion of the plurality of protrusions.

5. The system of claim 1, wherein the seal groove is formed in a joining surface of the shell stator, the joining surface being for receiving a further shell stator thereby to define at least one pumping chamber.

6. The system of claim 1, wherein the seal groove is formed in an end surface of the shell stator, the end surface being for receiving an end piece.

7. The system of claim 1, wherein the first side wall is an outermost wall, and the second side wall is an innermost wall.

8. The system of claim 1, wherein a thickness of the sealing gasket in a direction from the first side wall to the second side wall is less than a size of the seal groove in said direction.

9. The system of claim 8, wherein the sealing gasket has uniform thickness.

10. A vacuum pump, comprising:

shell stators defining at least one pumping chamber, a shell stator of the shell stators comprising:

a seal groove formed in a surface of the shell stator, the seal groove being defined by a first side wall, a second side wall opposite to the first side wall, and a bottom surface disposed between the first side wall and the second side wall, the bottom surface being opposite to an opening of the seal groove; wherein:

the seal groove comprises:

a protrusion formed in the first side wall and extending towards the second side wall, and an indentation formed in the second side wall opposite to the protrusion;

end pieces mounted at either end of the shell stators; and a sealing gasket disposed between the shell stators and the end pieces, the sealing gasket being disposed in the seal groove, wherein the protrusion biases at least part of the sealing gasket against the second side wall.

11. A vacuum pump comprising:

shell stators defining at least one pumping chamber, a shell stator of the shell stators comprising:

a seal groove formed in a surface of the shell stator, the seal groove being defined by a first side wall, a second side wall opposite to the first side wall, and a bottom surface disposed between the first side wall and the second side wall, the bottom surface being opposite to an opening of the seal groove; wherein the seal groove comprises:

a first protrusion formed in the first side wall and extending towards the second side wall, and a first indentation formed in the second side wall opposite to the first protrusion;

end pieces mounted at either end of the shell stators; and a sealing gasket disposed between the shell stators and the end pieces, the sealing gasket being disposed in the seal groove, wherein the first protrusion biases at least part of the sealing gasket against the second side wall, the vacuum pump further comprising:

two closed-shape sealing grooves, each closed-shape sealing groove being formed in a respective end of the shell stators; wherein the sealing gasket comprises two sealing members each defining a closed shape, each of the sealing members being disposed in a respective one of the closed-shape sealing grooves;

each closed-shape sealing groove is defined by an outer wall, an inner wall opposite to the outer wall, and a bottom surface disposed between the outer wall and the inner wall, the bottom surface being opposite to an opening of the closed-shape sealing groove; wherein each closed-shape sealing groove comprises:

a second protrusion formed in the outer wall and extending towards the inner wall; and a second indentation formed in the inner wall opposite to the second protrusion; and the second protrusion of a closed-shape sealing groove biases at least part of the sealing members disposed in that closed-shape sealing groove against the inner wall of that closed-shape sealing groove.

* * * * *